United States Patent [19]

Hirakawa et al.

[11] 4,420,999

[45] Dec. 20, 1983

[54] ROTARY PLATE-SHAPE MATERIAL CUTTING ARRANGEMENT

[75] Inventors: Tadashi Hirakawa; Toshiaki Kusubayashi; Yukio Oku, all of Mihara, Japan

[73] Assignee: Mitsubishi Jukogyo Kabushiki Kaisha, Japan

[21] Appl. No.: 349,970

[22] Filed: Feb. 18, 1982

[30] Foreign Application Priority Data

Feb. 23, 1981 [JP] Japan ..... 56-24230

[51] Int. Cl.[3] ..... B26D 1/62

[52] U.S. Cl. ..... 83/345; 83/343; 83/663

[58] Field of Search ..... 83/343, 344, 345, 346, 83/339, 663, 665, 674

[56] References Cited

U.S. PATENT DOCUMENTS 3,683,734 8/1972 Claussen ..... 83/345

FOREIGN PATENT DOCUMENTS 59157 9/1982 European Pat. Off. ..... 83/345

*Primary Examiner*—Donald R. Schran

*Attorney, Agent, or Firm*—McGlew and Tuttle

[57] ABSTRACT

A rotary plate-shape material cutting apparatus is disclosed. The apparatus comprises a pair of hollow knife cylinders, each provided with a knife on the circumferential surface and adapted to rotate in mutually opposite directions, shafts piercing the hollow portion of the knife cylinders and having both ends thereof supported by frames, bearings positioned at both ends of the knife cylinders and interposed between the shafts and knife cylinders and at least one roll provided at each of the knife cylinders, rotatably supported therein and having its rotary surface kept in contact with the external circumference of the shafts.

1 Claim, 6 Drawing Figures

ROTARY PLATE-SHAPE MATERIAL CUTTING ARRANGEMENT

This invention relates to a rotary plate-shape material cutting apparatus.

Firstly, one example of conventional rotary plate-shape material cutting apparatus will be explained with reference to a corrugate-type machine for cutting cardboard sheets.

In FIGS. 1, 2 and 3, there are shown an upper solid knife cylinder 1, a lower solid knife cylinder 2, knives 5 and 6 secured to the external circumference of the cylinders by means of bolts 3 and 4, both ends of the cylinders being rotatably supported by frames 8 and 9 through bearings 7 so that the cylinders can rotate in the same phase angle by means of gears 10 and 11 affixed to both ends thereof. A gear 12 is affixed to one shaft end of the lower solid knife cylinder through the bearing 7 and is in meshing engagement with a gear 13 so that both the knife cylinders 1 and 2 can be driven by a DC motor 14 connected to the gear 13 and the continuously travelling cardboard sheet 15 can be cut off when the upper knife 5 of the upper solid knife cylinder comes in meshing with the lower knife 6 of the lower solid knife cylinder.

In order to cut off the cardboard sheet to suitable lengths, both the knife cylinders 1 and 2 are so designed as they can rotate at unequal speeds by control means (not shown in the drawings). Namely, as shown in FIG. 3, while the upper knife 5 starts rotating in the direction of the arrow from its stop position and moves for the zone (I) until both the knives come in contact, it is accelerated in speed until its rotary speed becomes equal to the travelling speed of the cardboard sheet 15, and then, in the zone (II), it is rotated at the same speed as the travelling speed of the cardboard sheet 15, and after cutting off, it is reduced in speed in the zone (III) until its initial topmost stop position is reached, thus completing one rotation thereof. In this case, in order to cut off the cardboard sheet 15 to desired lengths, it is sufficient to adjust the times of speed reduction and stop by suitable means. By carrying out the aforesaid operation repeatedly, it is possible to cut off the cardboard sheet 15 in a continuous manner.

However, in the case of cutting by the aforesaid conventional apparatus, a deflection due to cutting load is sure to occur in the upper and lower solid knife cylinders until there is formed a clearance between both so that the cutting effect of the knives becomes worsened as an avoidable defect.

Therefore it is necessary to reduce a deflection of both the upper and lower knife cylinders for ensuring a satisfactory cutting effect.

For such a purpose, it has heretofore been customary to enlarge the diameters of both upper and lower knife cylinders, thereby enhancing bending rigidity. However, if such a procedure is taken to enhance bending rigidity of the upper and lower knife cylinders, $GD^2$ will be increased so that it becomes also necessary to increase horse power of a driving motor, and if so, an increase in power consumption will arise. Reversely, if horse power of the driving motor is to be reduced, it is necessary to make the diameters of both cylinders small, as the result of which the cutting effect of the knives is worsened as an ever unavoidable drawback.

The present invention is concerned with impriving such conventional rotary plate-shape material cutting apparatus accompanied by the aforesaid drawback.

So the characteristics of the invention consist in providing a pair of hollow knife cylinders, each equipped with a cutting knife on the circumference and adapted to rotate in mutually opposite directions, shafts piercing the hollow portion of the knife cylinders and having both ends thereof supported by frames, bearings positioned at both ends of the knife cylinders and interposed between the shafts and knife cylinders, at least one roll disposed in each of the cylinders and rotatably supported therein, its rotary surface being kept in contact with the external circumference of the shafts.

Namely, in order to improve the conventional apparatus with the aforesaid adversary drawback, the object of the present invention is to provide a rotary plate-shape material cutting apparatus with improvements in cutting effect and reduction of driving power consumption.

As aforesaid, the present invention is embodied such that the shafts are arranged piercing the hollow portion of the knife cylinders, the knife cylinders are rotatably supported by the shafts through bearings interposed inside both ends of the knife cylinders and one rotary roll is provided in a hole formed in the center of each of the hollow knife cylinders and brought into contact with the shaft whereby bending rigidity can be improved to a large extent and $GD^2$ of the rotary mechanism becomes lessened, cutting effect can be improved and simultaneously power consumption of a driving motor can be reduced satisfactorily.

The object, characteristics and advantage of the invention will become more apparent from the following detailed description and accompanying drawings.

Figure 1:
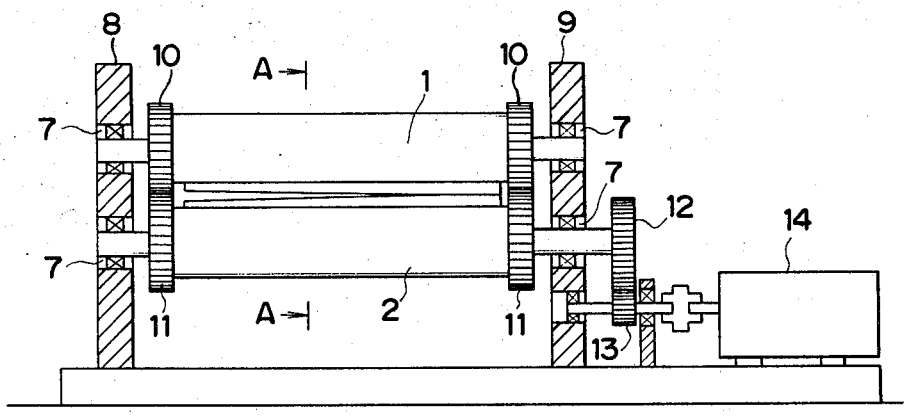
FIG. 1 PRIOR ART
FIG. 1 is a front view showing an outline of conventional rotary plate-shape material cutting apparatus.
Figure 2:
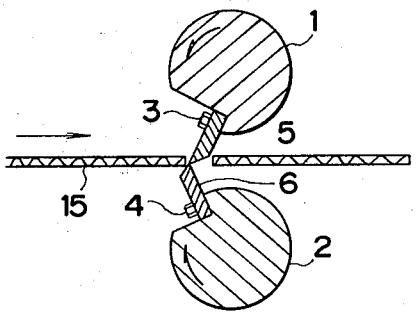
FIG. 2 PRIOR ART
FIG. 2 is a cross-sectional view taken along the line A—A of FIG. 1.
Figure 3:
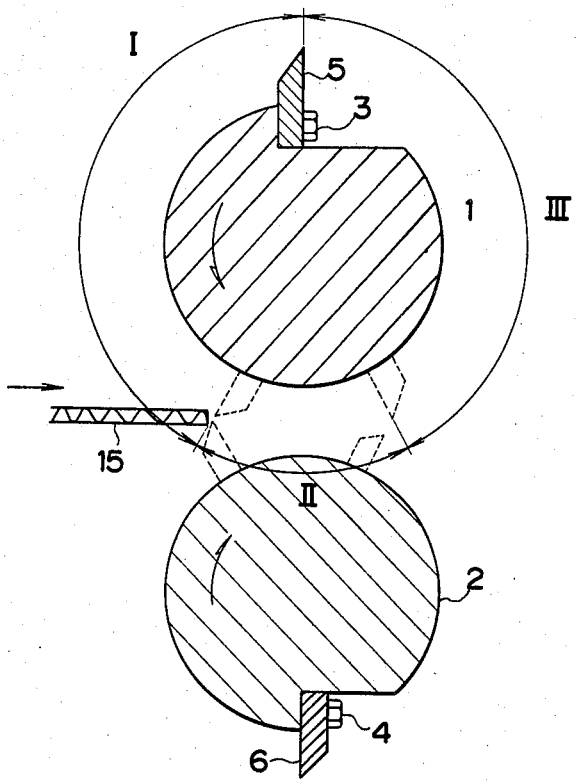
FIG. 3 PRIOR ART
FIG. 3 is an enlarged view showing a cutting operation of knife cylinders of conventional apparatus.
Figure 4:
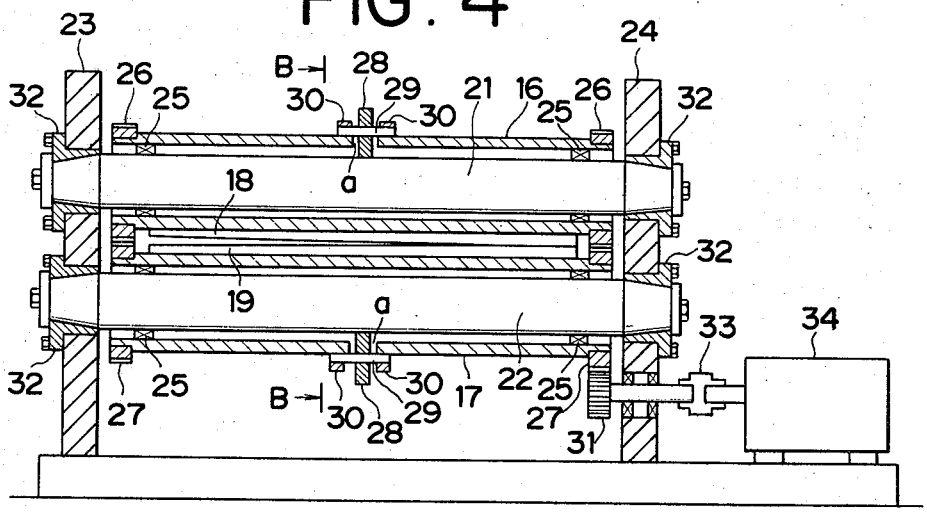
FIG. 4 is a front view showing the rotary plate-shape material cutting apparatus of the present invention and a cross section of the knife cylinders.
Figure 5:
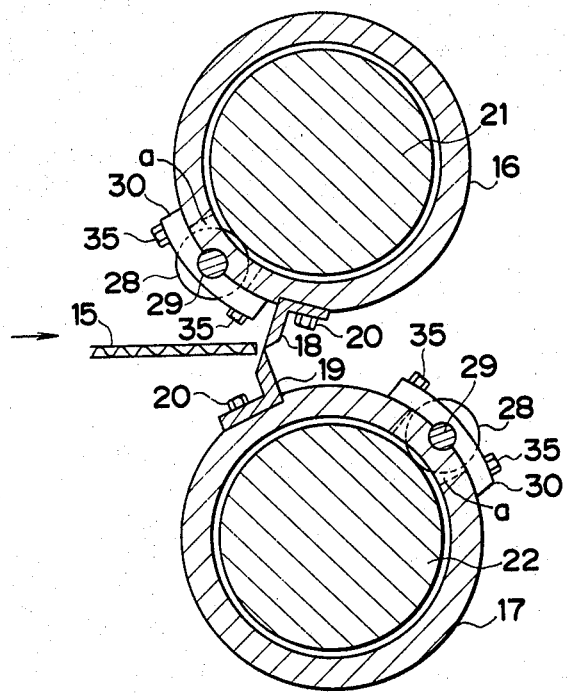
FIG. 5 is a cross-sectional view taken along the line B—B of FIG. 4.

A preferred embodiment of the invention will be explained with reference to FIGS. 4, 5 and 6.

In the drawings, numeral 16 designates an upper hollow knife cylinder, 17 a lower hollow knife cylinder and 18 and 19 are upper and lower knives respectively. The knives 18 and 19 are secured to the external circumference of both knife cylinders 16 and 17 by means of bolts 20. Shafts 21 and 22 are so provided as to pierce the hollow portion of the upper and lower hollow knife cylinders 16 and 17 respectively. The ends of both shafts 21 and 22 are firmly fixed by means of tapered sleeves 32 disposed at left and right frames 23 and 24 respectively. Bearings are interposed inside both ends of the upper and lower hollow knife cylinders 16 and 17 so as to have the upper and lower hollow knife cylinders rotatably supported by the shafts 21 and 22 respectively. Holes (a) are formed in the center of the upper and lower hollow knife cylinders 16 and 17 as shown in FIGS. 4 and 5 and rolls 28 rotatably supported by shafts 29 are arranged in the holes (a). These shafts 29 are supported by brackets 30 affixed to the upper and lower hollow knife cylinders 16 and 17 by means of bolts 35. The rolls 28 in the holes (a) are brought into contact with the shafts 21 and 22 so that a load to be received by the upper and lower hollow knife cylinders can be borne by the shafts 21 and 22. In meshing engagement are gears 26 and 27 secured to both ends of the upper hollow knife cylinder 16 and the lower hollow knife cylinder 17 so that the upper and lower hollow knife cylinders can rotate in the same phase angle. One of the gears 27 at both ends of the lower hollow knife cylinder is in meshing engagement with a gear 31 to which is connected a DC motor 34 through a coupling 33.

Figure 6:
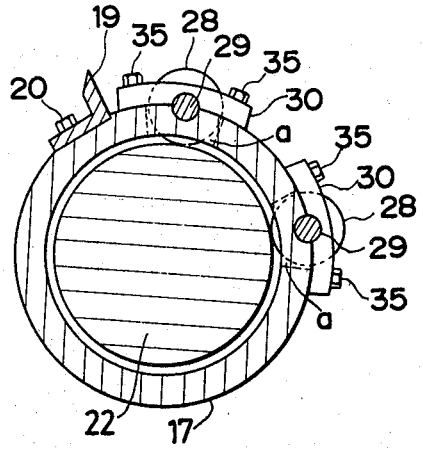
FIG. 6 is a cross-sectional view showing another preferred embodiment, taken along the line B—B of FIG. 4.

FIG. 6 shows another preferred embodiment wherein there are provided two rolls 28 in the center of the lower hollow knife cylinder 17, as distinguished from the previous embodiment provided with one roll. By providing two rolls in this manner, it is possible to bear cutting load by sharing, instead of one roll alone. Moreover, with a view to ensuring a further accurate share of cutting load, more than three rolls or a plurality of rolls 29 (not shown) may be provided in the external circumference of the lower hollow knife cylinder 17 in the same manner. In this case, such rolls have only to be arranged at suitable intervals in the circumferential as well as the axial direction.

According to the preferred embodiment of the invention as constructed above, when cutting the cardboard sheet 15, the upper and lower hollow knife cylinders 16 and 17 are caused to rotate at unequal speeds by a control mechanism (not shown) through the DC motor 34, coupling 33 and gears 31, 27 and 26 in the same manner as conventional apparatus so that the cardboard sheet 15 can be cut off to any suitable lengths.

The effect of the present apparatus will be explained in more detail hereinafter.

It is true that the upper and lower knife cylinders suffer a deflection due to cutting load occurring at the time of cutting and the amount of such deflection depends on the value of second moment of area I of the knife cylinders.

In general, a calculation of deflection of a beam subjected to concentrated load will be obtained on the basis of the following formula, $$y = \beta \frac{Wl^3}{EI}$$

wherein, y: deflection of central portion of beam $\beta$: condition of support beam W: load on central portion of beam E: modulus of longitudinal elasticity of beam I: second moment of area l: span of support of beam.

By applying the aforesaid formula to the calculation of deflection of the knife cylinders, a comparison of deflection between conventional apparatus and the present invention can be obtained as follows.

Conventional apparatus:

Since both ends of knife cylinders are supported by frames, the condition of support $\beta$ occurs as a type of support at both ends, showing $$\beta = 1/48$$

Given $I_0$ as second moment of area of the knife cylinder, the amount of deflection will be $$y = \frac{1}{48} \frac{Wl^3}{EI_0}$$

Present invention:

Since the shafts are firmly secured to frames, the condition of support can be regarded as a type of fixation at both ends, showing $$\beta = 1/192$$

In this case, cutting load W, support span l and modulus of longitudinal elasticity E are the same values in both conventional apparatus and the present invention. On the assumption that second moment of area of the hollow knife cylinders is $I_1$ and that of the shafts is $I_2$, since the hollow knife cylinders are supported by the shafts through bearings at both ends thereof and the roll in the center of the cylinders is provided in the direction of action of cutting load, such cutting load must act on the hollow knife cylinders and shafts. Consequently, when the sum of addition of $I_1$ and $I_2$ becomes equal to second moment of area of conventional knife cylinders such as $$I_0 = I_1 + I_2,$$

the deflection y of the knife cylinders is $$y = \frac{1}{192} \frac{Wl^3}{EI_0}$$

so that the amount of deflection in the present invention will be reduced to one-fourth of conventional one, thus contributing very much toward outstanding improvements in cutting effect.

According to another preferred embodiment shown in FIG. 6 two rolls instead of one are provided in the center of the lower hollow knife cylinder and so the shaft 22 is caused to bear cutting load by increased sharing. Consequently, the increase in the number of rolls 28 will lead to a larger extent of reduction of deflection, thereby enabling cutting effect to be enhanced in a satisfactory manner.

Next, the effect of reduction in power consumption will be explained hereinbelow.

In general, the required torque for a rotary body making accelerated and decelerated movements will be expressed by the following formula, $$T = \frac{GD_2(N_1 - N_0)}{375 \cdot t} \text{ (Kgm)}$$

wherein,

T: required torque $GD^2$: $GD^2$ of driven body t: time of acceleration and deceleration (time from $N_0$ to $N_1$)

$N_0$: number of revolutions of driven body before acceleration and deceleration $N_1$: number of revolutions of driven body accelerated and decelerated after t seconds Consequently, given $N_1 - N_0 = N$, power consumption will be expressed as $$P = \frac{T - N}{974} \text{ (KW)}$$

On the assumption that time of acceleration and deceleration t and r.p.m. of a motor N for the knife cylinder to be accelerated from its stop condition to a certain speed are the same in both conventional apparatus and the present invention, power consumption of the motor will depend on the size of $GD^2$ of the knife cylinder as a comparison of power consumption between conventional apparatus and the present invention.

The relationship between $GD^2$ and second moment of area I is understood as follows.

$$I_p = I_x + I_y$$

$I_p$: polar moment of inertia of area
$I_x$: second moment of area about neutral axis x
$I_y$: second moment of area about neutral axis y $$GD^2 = 4.r.L.I_p$$

r: specific weight
L: length of body with cross section $I_p$

Here, polar moment of inertia of area $I_p$ of the knife cylinder with a circular cross section is expressed as $I_p = 2\ I_0$ on the basis of $I_x = I_y = I_0$. On the supposition that the external diameter of a conventional solid knife cylinder is D while that of the hollow knife cylinder of the present invention is also D and its internal diameter is d, $I_p$ of conventional solid cylinder is expressed as $$I_p = \frac{\pi}{32} D^4$$

which may be termed as $I_{p1}$.

$I_p$ of the hollow knife cylinder of the present invention is expressed as $$I_p = \frac{\pi}{32} (D^4 - d^4)$$

which may be termed as $I_{p2}$.

Also on condition that specific weight r of the knife cylinder and its surface length L are the same in both conventional apparatus and the present invention, their respective $GD^2$ will be obtained as follows.

In conventional apparatus:

$$GD_1^2 = 4.r.L.I_{p1}$$

In the present invention:

$$GD_2^2 = 4.r.L.I_{p2}$$

Therefore, their ratio can be expressed as $$\frac{GD_2^2}{GD_1^2} = \frac{I_{p2}}{I_{p1}} = \frac{D^4 - d^4}{D^4}$$

On the supposition that D is 250 mm and d is 180 mm, the ratio of $GD_2^2$ of the present invention to $GD_1^2$ of conventional apparatus will become 73% as an example.

So, whereas conventional apparatus requires a 75 KW motor, the present invention requires a 55 KW motor which will do well with the use of the knife cylinder of the present invention.

Thus, according to the present invention, bending rigidity can be improved quite satisfactorily and at the same time, power consumption can be reduced to a remarkable degree.

While the invention has been explained with reference to its preferred embodiment thus far, it is apparent that the invention is not limited to such preferred embodiment only but modifications of various desings can be made within the range of appended claim without departing from the spirit of the present invention.

What is claimed is:

1. A rotary plate-shaped material cutting apparatus which comprises a pair of hollow knife cylinders, each provided with a cutting knife and adapted to rotate in mutally opposite directions, shafts piercing the hollow portion of the knife cylinders and having both ends thereof supported by frames, bearings positioned at both ends of the knife cylinders and interposed between the shafts and knife cylinders and at least one roll provided at each of the knife cylinders, rotatably supported therein and having its rotary surface kept in contact with the external circumference of the shafts.

* * * * *